US007650100B2

(12) United States Patent
Murata et al.

(10) Patent No.: US 7,650,100 B2
(45) Date of Patent: Jan. 19, 2010

(54) DEVELOPMENT APPARATUS, IMAGE FORMING APPARATUS, AND DEVELOPER TRANSFER METHOD

(75) Inventors: Hiroshi Murata, Yokohama (JP); Minoru Yoshida, Machida (JP); Takashi Hatakeyama, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 527 days.

(21) Appl. No.: 11/456,986

(22) Filed: Jul. 12, 2006

(65) Prior Publication Data

US 2008/0273888 A1 Nov. 6, 2008

(51) Int. Cl.
*G03G 15/08* (2006.01)

(52) U.S. Cl. ..... 399/253

(58) Field of Classification Search ..... 399/253, 399/30, 43, 58, 62, 199, 120, 256, 260, 263, 399/119

See application file for complete search history.

(56) References Cited

U.S. PATENT DOCUMENTS 7,003,233 B2 * 2/2006 Matsuda et al. ..... 399/27

FOREIGN PATENT DOCUMENTS

| | | |
|---|---|---|
| JP | 09-185177 | 7/1997 |
| JP | 2000-081787 | 3/2000 |
| JP | 2001215797 A * | 8/2001 |

* cited by examiner

*Primary Examiner*—David M Gray
*Assistant Examiner*—Andrew V Do
(74) *Attorney, Agent, or Firm*—Turocy & Watson, LLP

(57) ABSTRACT

There is provided a technique in which in a development apparatus to perform replacement of developer, the amount of developer can be stably kept irrespective of a change in a physical property of the developer. There are included a development apparatus that circulates and conveys a developer supplied at a specified timing in a specified conveying chamber and causes the developer to overflow through a discharge port provided in the conveying chamber, a fluidity judgment unit to judge a degree of fluidity of the developer in the conveying chamber, and a speed control unit to control a conveying speed of the developer in a specified range near the discharge port in the conveying chamber to become low relative to an average value of a conveying speed of the developer in a conveying passage except the specified range when the fluidity judged by the fluidity judgment unit is low.

17 Claims, 7 Drawing Sheets

FIG.8

| | ANGLE OF REPOSE OF DEVELOPER (FLUIDITY) | | FLUIDITY CHANGE DEGREE | DECELERATION RATIO OF DEVELOPER FLOW RATE IN DISCHARGE PART | DECELERATION MEANS OF FLOW RATE | a VALUE | DEVELOPER AMOUNT CHANGE RATE | JUDGMENT RESULT | STATE OF DEFECT |
|---|---|---|---|---|---|---|---|---|---|
| | INITIAL | AFTER CHANGE | | | | | | | |
| EXAMPLE 1 | 30 | 41 | 1.37 | 0.5 | MIXER SHAPE CHANGE | 0.68 | +11% | ○ | |
| EXAMPLE 2 | 30 | 41 | 1.37 | 0.3 | MIXER SHAPE CHANGE | 0.41 | +7% | ○ | |
| EXAMPLE 3 | 30 | 41 | 1.37 | 0.16 | MIXER SHAPE CHANGE | 0.22 | +3% | ○ | |
| EXAMPLE 4 | 31 | 49 | 1.58 | 0.2 | MIXER SHAPE CHANGE | 0.32 | +9% | ○ | |
| EXAMPLE 5 | 31 | 49 | 1.58 | 0.4 | MIXER SHAPE CHANGE | 0.63 | +14% | ○ | |
| EXAMPLE 6 | 31 | 49 | 1.58 | 0.4 | CORNER PORTION DISCHARGE IN DEVELOPING UNIT | 0.63 | +17% | ○ | |
| EXAMPLE 7 | 35 | 36 | 1.03 | 0.95 | FLOW PASSAGE WIDTH NARROW | 0.98 | +5% | ○ | |
| EXAMPLE 8 | 35 | 36 | 1.03 | 0.4 | CORNER PORTION DISCHARGE IN DEVELOPING UNIT | 0.41 | +6% | ○ | |
| EXAMPLE 9 | 35 | 31 | 0.89 | 0.9 | FLOW PASSAGE WIDTH NARROW | 0.80 | −6% | ○ | |
| EXAMPLE 10 | 35 | 31 | 0.89 | 0.3 | MIXER SHAPE CHANGE | 0.27 | −7% | ○ | |
| COMPARATIVE EXAMPLE 1 | 30 | 41 | 1.37 | 1 | NO | 1.37 | +38% | × | DEVELOPER LEAK, DEFECT CHARGING |
| COMPARATIVE EXAMPLE 2 | 30 | 41 | 1.37 | 0.1 | MIXER SHAPE CHANGE | 0.14 | +23% | △ | DEVELOPING UNIT TORQUE LARGE |
| COMPARATIVE EXAMPLE 3 | 31 | 49 | 1.58 | 1 | NO | 1.58 | +44% | × | DEVELOPER LEAK, DEFECT CHARGING |
| COMPARATIVE EXAMPLE 4 | 31 | 49 | 1.58 | 0.07 | MIXER SHAPE CHANGE | 0.11 | +18% | × | DEVELOPING UNIT TORQUE LARGE |
| COMPARATIVE EXAMPLE 5 | 35 | 31 | 0.89 | 0.1 | MIXER SHAPE CHANGE | 0.09 | −28% | × | DEVELOPING ROLLER CONVEYING DEFECT |

DEVELOPMENT APPARATUS, IMAGE FORMING APPARATUS, AND DEVELOPER TRANSFER METHOD

BACKGROUND OF THE INVENTION

1. Field of the Invention

The present invention relates to a development apparatus adopting a so-called overflow system, and particularly to a developer conveying technique.

2. Description of the Related Art

Heretofore, in a development technique to perform development processing with a two-component developer including carrier and toner, in order to prevent deterioration of image characteristics due to the peeling of a resin coat material of the surface of the carrier resulting from the consumption of the toner or the lowering of charging performance as the developer by the attachment of a toner component to the surface of the carrier, a system of supplying the toner and carrier into the development apparatus has been proposed. Specifically, there is known a method in which toner and carrier are separately supplied, or a method in which a toner cartridge to be replenished is mixed with a small amount of carrier and they are supplied to a development apparatus (see JP-A-62-127874).

Heretofore, when developer reaches the end of its life, a total replacement operation is performed, however, in this system, carrier is also supplied during a normal developing operation at the same time as the toner. Although the toner is consumed by the development, since the supplied carrier remains in a container of the development apparatus, when toner density in the development container is kept constant, the bulk of the developer is increased. In order to deal with the increase in the bulk of the developer as stated above, there is known a method in which the so-called overflow is used and the developer is discharged to the outside of the development container. Besides, there is also known a system in which a part of the developer is mechanically discharged by control, and a new developer is supplied, so that the developer in the development apparatus is replaced (see JP-A-6-301289).

As stated above, the developer which reaches the end of its life and is deteriorated is partially replaced by a new one, and the developer performance is kept, so that the number of times of collective replacement of the developer is reduced, and the maintenance property is improved.

In the development apparatus to perform the replacement of the developer as described above, there is known a technique in which in order to keep the amount of developer to be constant, bulk density is regulated as an index of the fluidity of the developer (JP-A-9-185177), however, since the developer is changed according to the use state, it is not practical. Besides, there is known a technique in which a low conveying unit of developer is provided by decreasing the diameter of a developer agitating wing or the pitch, and discharge of the developer is performed (JP-A-2000-81787).

However, in the above related art, it is impossible to deal with a change in a physical property of a developer resulting from a use condition, such as arrival to the end of its life due to deterioration or an environmental change, and there has been a case where the amount of developer can not be kept to be constant. That is, in the above related art, there is a case where the discharge of the developer is not sufficiently performed due to the change in the physical property of the developer, and it has not been sufficient for proper maintenance of the amount of the developer and for maintenance of the performance of the developer.

SUMMARY OF THE INVENTION

The invention has been made to solve the foregoing problems, and it is an object to provide a technique in which in a development apparatus to perform replacement of developer, the amount of the developer can be stably kept irrespective of a change in a physical property of the developer.

In order to solve the problem, a development apparatus according to an aspect of the invention is a development apparatus and includes a conveying chamber that circulates and conveys a developer supplied at a specified timing and causes the developer to overflow through a discharge port provided in the conveying chamber, a first conveying unit configured to convey the developer in a specified range near the discharge port in the conveying chamber, a second conveying unit configured to convey the developer in a conveying passage except the specified range in the conveying chamber, and a speed ratio changing unit capable of changing a speed ratio of a conveying speed of the developer by the first conveying unit to a conveying speed of the developer by the second conveying unit.

Besides, an image forming apparatus according to an aspect of the invention includes a development apparatus that circulates and conveys a developer supplied at a specified timing in a specified conveying chamber and causes the developer to overflow through a discharge port provided in the conveying chamber, a fluidity judgment unit configured to judge a degree of fluidity of the developer in the conveying chamber, and a speed control unit configured to control a conveying speed of the developer in a specified range near the discharge port in the conveying chamber to become low relative to an average value of a conveying speed of the developer in a conveying passage except the specified range when the fluidity judged by the fluidity judgment unit is low.

Besides, a developer conveying method according to an aspect of the invention is a developer conveying method in an image forming apparatus including a development apparatus that circulates and conveys a developer supplied at a specified timing in a specified conveying chamber and causes the developer to overflow through a discharge port provided in the conveying chamber, and includes judging a degree of fluidity of the developer in the conveying chamber, and controlling a conveying speed of the developer in a specified range near the discharge port in the conveying chamber to become low relative to an average value of a conveying speed of the developer in a conveying passage except the specified range when the judged fluidity is low.

DESCRIPTION OF THE DRAWINGS

FIG. 8 is a table showing evaluation results concerning a change in the amount of developer in a case where use conditions such as the life of the developer and an environment are changed.

DESCRIPTION OF THE EMBODIMENTS

Hereinafter, embodiments of the invention will be described with reference to the drawings.

As a result of research on the cause of an increase in the amount of developer in a development apparatus adopting the so-called overflow system, it has been found that the developer with a large change in fluidity is apt to cause an increase in the amount of developer, and it is necessary to set the degree of deceleration so that the flow rate of the developer in the vicinity of a discharge port falls within a suitable range.

It has been found that there is a phenomenon in which with the reduction in the fluidity of developer, conveying efficiency in the development apparatus is reduced, and the developer tends to be accumulated in a specific region in a developer conveying passage in the development apparatus, and accordingly, the developer corresponding to (equivalent to) the supplied developer is not discharged, and consequently, the amount of the developer is increased.

In the invention, the flow rate of the developer in the vicinity of the discharge port is decelerated under a suitable condition, and an increase in the amount of the developer due to unnecessary accumulation of the developer in the other portion is eliminated. The deceleration (accumulation) is caused in the vicinity of the discharge port, so that the action is used for discharge, the discharge is efficiently performed, and the amount of the developer in the development apparatus can be stabilized.

Hereinafter, a description will be given to a structure for controlling the flow rate of developer in a discharge port in a development apparatus to within a suitable range in this embodiment.

Figure 1:
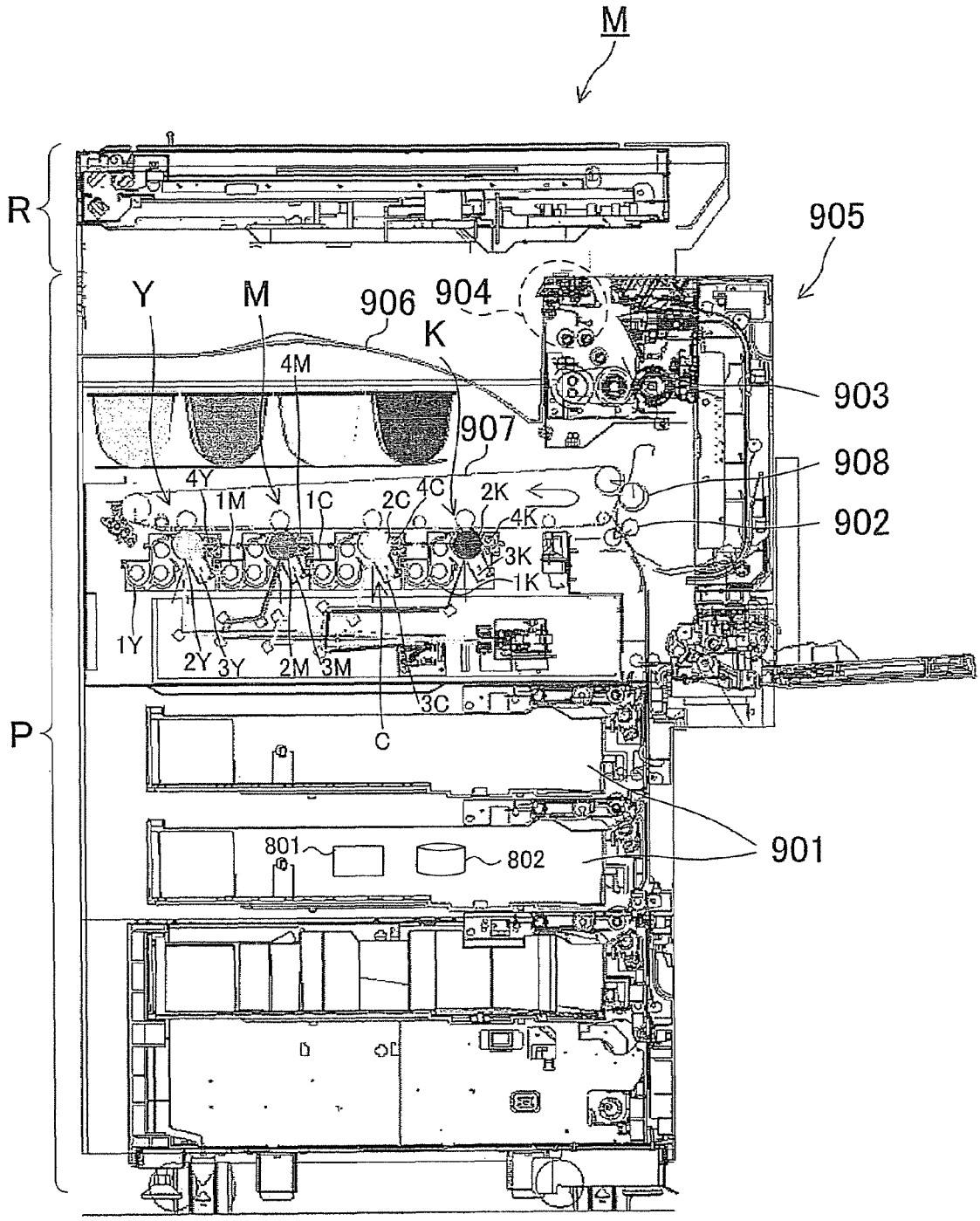
FIG. 1 is a whole structure view of an image forming apparatus of an embodiment.

FIG. 1 is a whole structure view for explaining an image forming apparatus according to an embodiment. The image forming apparatus M of the embodiment includes an image reading unit R to read an image of a document, and an image forming unit P to form an image on a sheet. Besides, in the image forming apparatus M, based on image data read from the document by the image reading unit R, the image can be formed on the sheet by the image forming unit P.

Specifically, the image forming unit P includes process units Y, M, C and K, a paper feed cassette 901, a register roller 902, a secondary transfer roller 908, a fixing unit 903, a paper discharge roller 904, an ADU (AUTO DUPLEX UNIT) 905, a paper discharge tray 906, an intermediate transfer belt 907, a CPU 801, and a MEMORY 802. The respective process units Y, M, C and K integrally include photoconductive bodies 2Y, 2M, 2C and 2K, development apparatuses 1Y, 1M, 1C and 1K, chargers 3Y, 3M, 3C and 3K, and cleaning units 4Y, 4M, 4C and 4K. Each of the process units is attachably and detachably provided to a main body of the image forming apparatus.

Incidentally, here, the development apparatuses 1Y, 1M, 1C and 1K are attachable to and detachable from the image forming apparatus M for maintenance and the like. Besides, the development apparatuses 1Y, 1M, 1C and 1K have structures in which while developer supplied at a specified timing is circulated and conveyed in an annular conveying chamber, the developer is overflown through a discharge port provided in a side wall (or a ceiling portion) of a housing of the conveying chamber.

Next, the outline of a copy operation in the image forming apparatus M according to the embodiment will be described.

First, based on image data read from the document by the image reading unit R or image data acquired from an external equipment connected to be capable of communicating with the image forming apparatus M or from a storage area in the image forming apparatus M, electrostatic latent images are formed on the photoconductive bodies 2Y, 2M, 2C and 2K in the respective process units.

The electrostatic latent images formed on the photoconductive bodies 2Y, 2M, 2C and 2K in this way are visualized by the development apparatuses 1Y, 1M, 1C and 1K, and the visualized images are transferred to the sheet conveyed from the sheet cassette 901 through the register roller 902 to the secondary transfer roller 908.

The sheet on which the developer images have been transferred is heated and fixed to the sheet by the fixing unit 903. The sheet on which the developer images have been heated and fixed is discharged onto the paper discharge tray 906 by the paper discharge roller 904.

The CPU 801 serves to perform various processings in the image forming apparatus M and also serves to realize various functions by executing programs stored in the MEMORY 802. The MEMORY 802 includes, for example, a ROM, a RAM and the like, and serves to store various information and programs used in the image forming apparatus M.

In the embodiment, although the structure of the color image forming apparatus using the normal electrophotographic system has been described as an example, no limitation is made to this, and the invention can be applied also to a monochrome image forming apparatus. Incidentally, here, although the structure of the image forming apparatus of the so-called intermediate transfer system is used as an example, in addition to this, the invention can be applied also to an image forming apparatus of a system in which fixing is performed after plural color toners are superimposed on one photoconductive body and are transferred.

Figure 2:
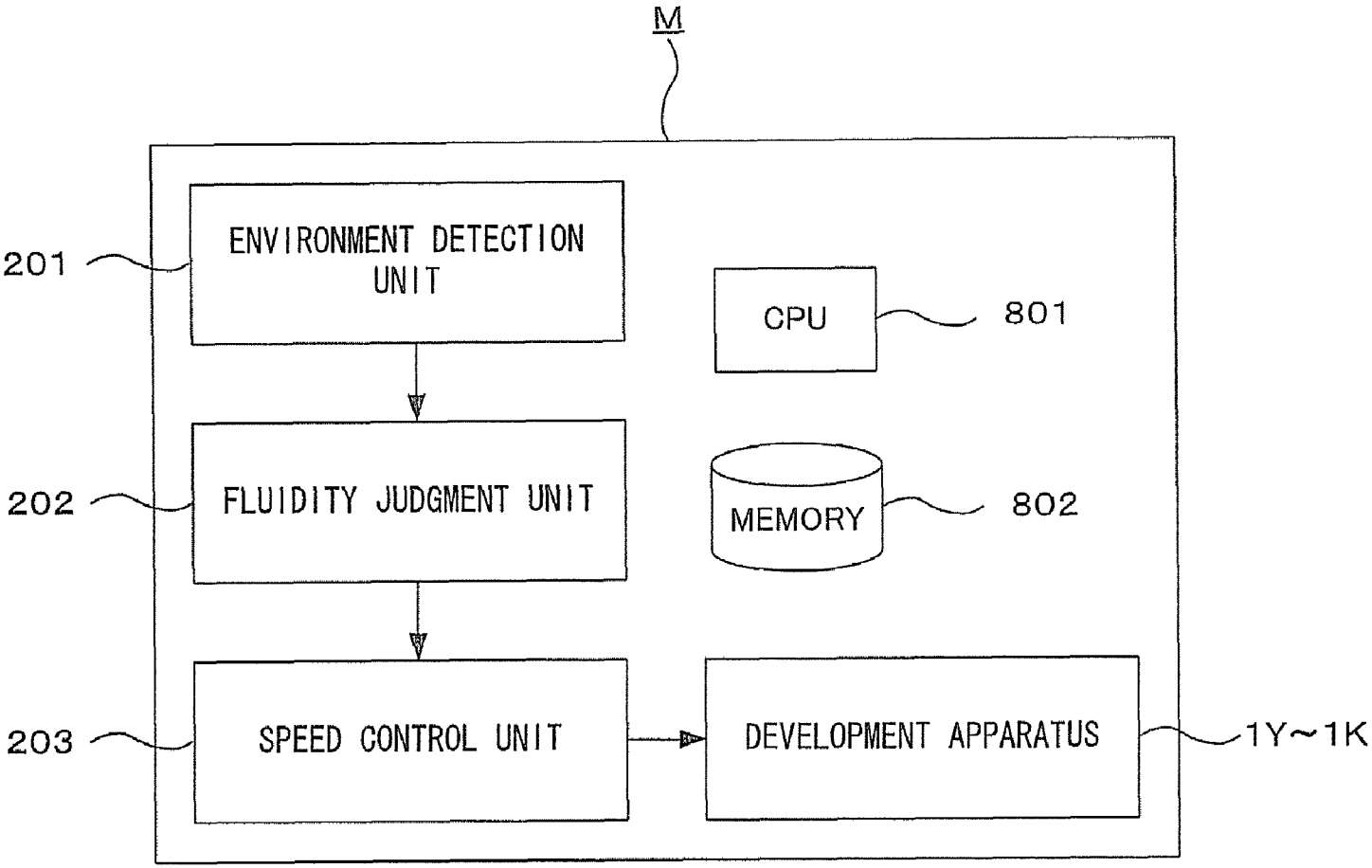
FIG. 2 is a functional block diagram for explaining the image forming apparatus of the embodiment.

FIG. 2 is a functional block diagram for explaining the image forming apparatus of the embodiment. The image forming apparatus M of the embodiment includes the development apparatuses 1Y to 1K, an environment detection unit 201, a fluidity judgment unit 202, a speed control unit 203, the CPU 801 and the MEMORY 802.

The environment detection unit 201 detects the temperature and humidity in the development apparatuses 1Y to 1K.

The fluidity judgment unit 202 serves to judge the degree of fluidity of the developer in a conveying chamber to circulate and convey the developer in the development apparatus. The fluidity judgment unit 202 judges that as the temperature and humidity detected by the environment detection unit 201 become high temperature and high humidity, the fluidity is low. Of course, a threshold as a high temperature and high humidity environment is set, and it is also possible to make a judgment that high temperature and high humidity are present in a case where the temperature and humidity exceed the threshold.

Besides, the fluidity judgment unit 202 can make a judgment that as the number of times of image formation processing in the image forming apparatus from the time when a specified developer supply processing is performed for the conveying chamber (the time when the developer is replaced, the counter value is reset, or the like) becomes large (as the developer approaches the end of its life), the fluidity is low. Incidentally, the count of the number of times of image formation processing in the fluidity judgment unit 202 is performed based on the counter value to record the number of times of image formation processing in the image forming apparatus M.

Besides, in the case where the image forming apparatus M can perform the image formation processing at plural process speeds different from each other, the fluidity judgment unit 202 judges that as the process speed at the time when the image formation processing is performed in the image forming apparatus M becomes low, the fluidity is low. Specifically, the fluidity judgment unit 202 judges that when the process speed (rotation speed of a mixer) is reduced, the fluidity becomes poor.

The speed control unit 203 serves to perform such a control that when the fluidity judged by the fluidity judgment unit 202 is low, the conveying speed of the developer in a specified range near the discharge port in the conveying chamber becomes low relative to the average value of the conveying speed of the developer in the conveying passage except the specified range (or the average value of the conveying speed of the developer in the whole conveying chamber).

When the conveying speed of the developer in the specified range near the discharge port 1*e* in the conveying chamber is V1, and the average value of the conveying speed of the developer in the conveying passage except the specified range is V2, the speed control unit 203 performs a control to establish $$V1/V2=0.1 \text{ to } 0.7 \quad (1)$$

Here, it is preferable that the speed control unit 203 performs a control so that the conveying speed of the developer in the specified range near the discharge port 1*e* in the conveying chamber H becomes the slowest speed among the developer conveying speeds in the conveying chamber H.

Figure 3:
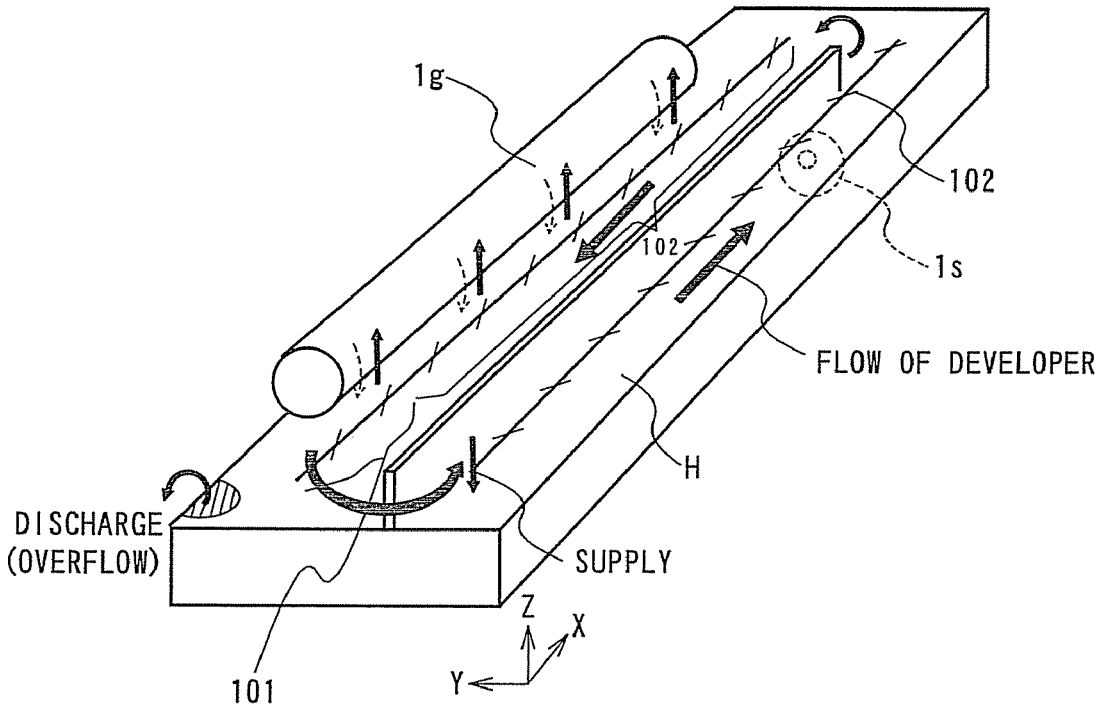
FIG. 3 is a view for explaining a structure of a development apparatus 1Y.

Next, the detailed structure of the development apparatuses 1Y to 1K will be described. Here, the development apparatuses 1Y to 1K have the same basic structure, therefore, the structure of the development apparatus 1Y will be described as an example. FIG. 3 is a view for explaining the structure of the development apparatus 1Y.

The development apparatus 1Y includes a developing roller 1*g*, the conveying chamber H, a first conveying unit 101, a second conveying unit 102, a speed ratio changing unit 103, and a toner density sensor 1*s*.

The conveying chamber H is for circulating and conveying the developer supplied at a specified timing, and causes the developer to overflow through a discharge port 1*e* provided in the side wall of the conveying chamber H. As stated above, by adopting the overflow system, the replacement of the developer in the development apparatus is automatically performed.

The first conveying unit 101 serves to convey the developer in the specified range near the discharge port in the conveying chamber H, and includes a spiral wing (auger) rotatable around a specified axis as a center axis.

The second conveying unit 102 serves to convey the developer in the conveying passage except the specified range in the conveying chamber H, and includes a spiral wing (auger) rotatable around a specified axis as a center axis. The second conveying unit 102 can be rotation-driven independently of the first conveying unit 101.

The speed ratio changing unit 103 has a function to change the speed ratio of the conveying speed of the developer by the first conveying unit 101 to the conveying speed of the developer by the second conveying unit 102 based on the instruction (or power transmission) from the image forming apparatus M.

The developing roller 1*g* serves to transport the developer in the development apparatus 1*y* to the photoconductive surface of the photoconductive body 2Y.

Figure 4:
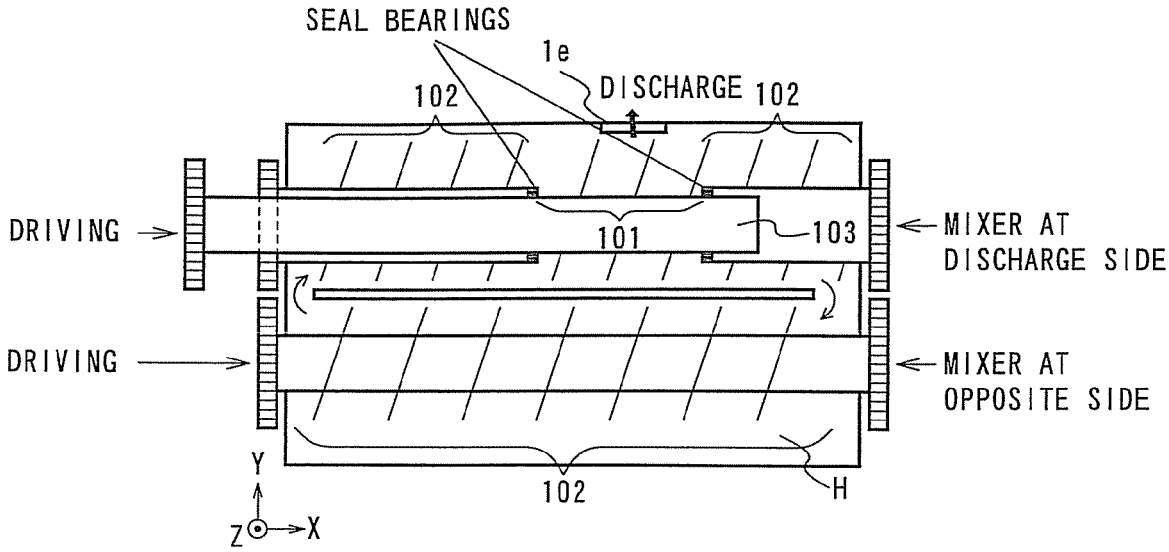
FIG. 4 is a view for explaining a structural example of a speed ratio changing unit 103.

FIG. 4 is a view for explaining a structural example of the speed ratio changing unit 103. The speed ratio changing unit 103 shown in the drawing is a mechanism to enable the first conveying unit 101 and the second conveying 102 to be independently rotation-driven by power transmission through a gear from the image forming apparatus M. The first conveying unit 101 and the second conveying unit 102 are disposed through seal bearings. By adopting the structure as stated above, the speed control unit 203 can change the ratio of the conveying speed of the developer by the first conveying unit 101 to the conveying speed of the developer by the second conveying unit 102.

Figure 5:
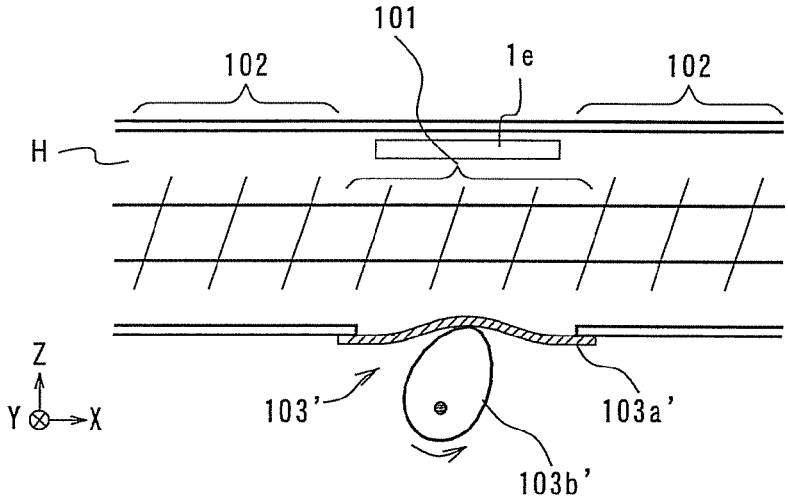
FIG. 5 is a view for explaining a structural example of an area changing unit 103'.

FIG. 5 is a view for explaining a structural example of an area changing unit 103'. The area changing unit 103' shown in the drawing is a structure which is adopted in a case where the rotation radius of the first conveying unit 101 is smaller than the rotation radius of the second conveying unit 102 (or in a case where the spiral wing of the auger does not exist only in the vicinity of the discharge port 1*e*), and the side wall in the conveying chamber H or the bottom near the discharge port 1*e* can be made to protrude. Incidentally, in the case of adopting the structure in which the area changing unit 103' is provided, it is not always necessary to divide the auger in the vicinity of the discharge port 1*e* into the first and the second conveying units.

Besides, in FIG. 5, the area changing unit 103' has a structure in which a plate-like member 103*a*' made of an elastic member is pressed and deformed from the outside of the housing of the development apparatus by a cam 103*b*' rotation-driven by a motor or the like, so that it is protruded into the conveying chamber H. That is, the area changing unit 103' has a function to change the sectional area (sectional area in a direction substantially perpendicular to the developer conveying direction) of the conveying passage in the specified range near the discharge port 1*e* in the conveying chamber H based on the rotation angle of the cam 103*b*'. Here, the rotation angle of the cam 103*b*' is controlled based on, for example, the control signal from the CPU 801. By this, the speed control unit 203 can change the sectional area of the conveying passage in the specified range near the discharge port 1*e* by the area changing unit 103'. As stated above, by adopting the structure in which the sectional area of the conveying passage can be changed by the area changing unit 103', in the case where the sectional area is narrowed, the flow passage of the developer is narrowed, and the conveying speed of the developer near the discharge port 1*e* where the sectional area is narrowed becomes slow. By this, the developer tends to swell in the vicinity of the discharge port 1*e* in the conveying chamber H, and the stable discharge of the developer by the overflow becomes possible.

Incidentally, the development apparatus 1Y of the embodiment uses, as the developer, a two-component developer including a toner and a magnetic carrier, and uses, as the toner density sensor is, a well-known magnetic one (permeability sensor). The toner and carrier are supplied from a developer cartridge, are conveyed in the development apparatus, and are mixed with the developer. Since the carrier is supplied, the bulk of the developer in the development apparatus is increased, and accordingly, a bank is provided at the discharge port 1*e*, and the discharge of the developer is performed using a fact that the developer overflows in a case where it exceeds a specified height.

Figure 6:
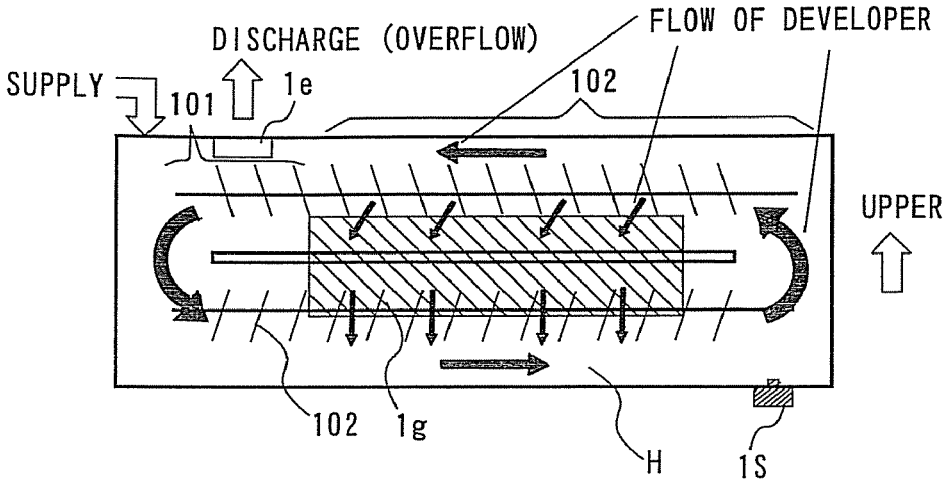
FIG. 6 is a view showing an example of a structure to move a developer in a development apparatus toward a horizontal direction by a developing roller.

Incidentally, in the embodiment, although the structure has been described in which the developer in the development apparatus is moved in the vertical direction by the developing roller, no limitation is made to this, and for example, as shown in FIG. 6, the structure may be such that the developer in the development apparatus is moved in the horizontal direction by the developing roller.

Next, the material of the developer will be described. For both the toner and carrier, a well-known material and constitution can be used. Specifically, the toner includes, as main ingredients, a binding resin and a coloring agent. As the binding resin, polystyrene, styrene acryl copolymer, polyester, epoxy resin, silicone resin, polyamide, paraffin wax or the like can be used.

As the coloring agent, a well-known pigment and dye are used, and carbon black, aniline blue, chrome yellow, ultra marine blue, copper phthalocyanine, pigment blue, pigment red, pigment yellow or the like is used. Besides, a charging control agent, a cleaning auxiliary agent, a peeling accelerating agent, a fluidity accelerating agent or the like can be included as the need arises.

As the carrier, a magnetic particle of ferrite, iron oxide or the like is used, or these are used as core materials and what are obtained by covering them with resin can be used.

As the resin covering the carrier, a well-known one such as fluorocarbon resin, acrylic resin, or silicone resin can be used, and one of or a combination of plural kinds of these can be used. Besides, what is obtained by mixing resin with magnetic powder can be used.

Next, the developer for replenishment will be described. The two-component developer in which the toner and carrier are mixed can be formed by a mixing apparatus such as a Henschel mixer. The developer for replenishment is prepared by mixing a small amount of carrier with toner. In this embodiment, the toner density of the developer for replenishment was 90%. Incidentally, as a replenishment mode of the developer to the development apparatus, in addition to a mixture of carrier with toner, the toner and carrier can be separately replenished.

Hereinafter, effects of the embodiment will be described.

First, measurement of an angle of repose as an index of the fluidity of developer will be described. The measurement was performed using a powder tester made by Hosokawa Micron Corporation and by a specified method. The angle of repose was measured for the developer in the initial state and the developer after being used for the life test. Besides, the measurement was made also in the case where the temperature and humidity environment was changed.

Figure 7:
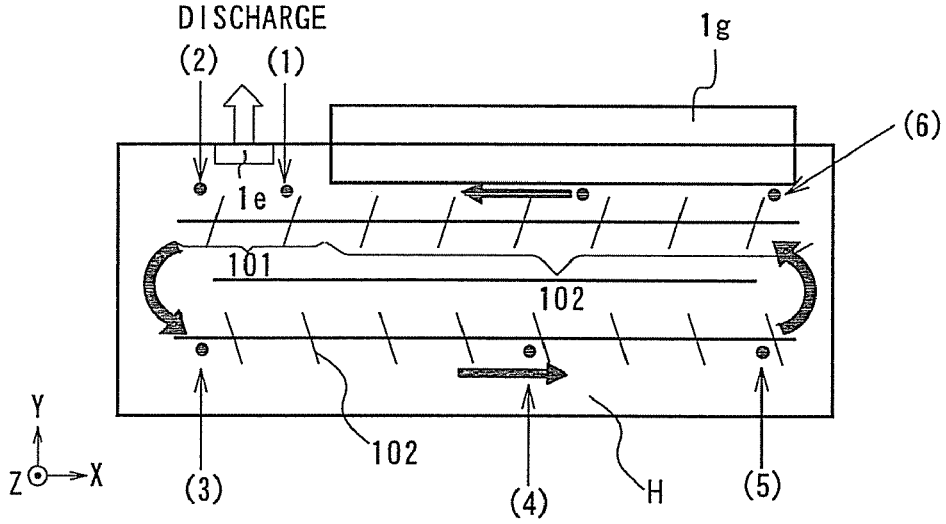
FIG. 7 is a view showing an example of a test machine for measuring the flow rate of developer in the development apparatus.

Next, measurement of the flow rate of developer in the development apparatus will be described. In order to measure the flow rate of the developer in the development apparatus, a development apparatus as shown in FIG. 7 was used as a test machine. Here, as shown in FIG. 7, magnetic toner density sensors were disposed at several places (1) to (6) in a conveying chamber H of developer and the measurement was performed. Here, a small amount of toner was put in the place (3) in the development apparatus, and the outputs of the respective toner density sensors disposed were simultaneously monitored.

When the input toner passes through an upper part of the toner density sensor, the peak of an output value is detected. By observing a time difference between the peak values detected by the respective sensors, the developer conveying speed between the points can be measured.

In the example shown in FIG. 7, the conveying speed in the vicinity of the discharge port 1*e* of the developer was obtained from the values measured between (1) and (2). The average conveying speed in the development apparatus was obtained from a time required for the developer to make a round from a point of a certain sensor (peak was again detected). Of course, the discharge position of the developer is not limited to the position as shown in the drawing.

Next, the evaluation of a change in the amount of developer (evaluation of developer discharge property) in the development apparatus will be described. Here, the image output of 300000 sheets in total was performed. As an output image, a document with an image printing ratio of 10% was used. Each time 1000 sheets were printed, the weight of each development apparatus was measured and the amount of developer was obtained. With respect to the amount of developer at the time when the image output was started, when the amount of developer was most increased or decreased due to the life (life of the developer), a developer amount change rate was obtained.

Next, a description will be given to a change in the amount of developer in the case where a use condition such as a developer life or an environment is changed. FIG. 8 is a table in which the evaluation results are listed. In the drawing, input parameter: an angle of repose, a degree of change of developer fluidity, control parameter: a deceleration rate of developer flow rate at discharge part, specific means of deceleration, output parameter: a change in the amount of developer in actual machine evaluation, image defect, and others.

Hereinafter, a description will be given to the propriety of a condition range indicated in this embodiment by using developers different in the change of developer fluidity in respective examples and comparative examples, and by using several means as means for decelerating the developer flow rate of the developer in the vicinity of the developer discharge port.

Examples 1 to 3

The angles of repose were measured as the developer fluidity before and after 300000 sheets were made for the developer life, and the developer with 30° at the beginning and 41° after the life was used.

As means for changing the developer flow rate in the vicinity of the discharge port 1*e*, a method was adopted in which the pitch between wings of a mixer (auger) was made small only in the vicinity of the discharge port, or the rotation radius of the wing of the mixer (auger) was made small only in the vicinity of the discharge port. Here, Example 1: mixer pitch ½, Example 2: mixer diameter ½, Example 3: mixer pitch ¼.

Here, the mixer diameter and pitch of a normal developer conveying unit (except the discharge port) are made 1, and the conditions are indicated by multiples thereof.

The apparatus shown in FIG. 7 was used, and the average flow rate of the developer in the development apparatus and the flow rate of the developer in the vicinity of the discharge port were measured.

The average flow rate of the developer in the development apparatus is 50 mm/sec, and the deceleration ratio shown in FIG. 8 is determined by measuring the flow rate in the discharge part. The value of a is also shown.

In examples 1 to 3, there was no problem in the change ratio (increase amount) of the developer, and a defect did not occur. It is preferable that the developer amount change rate is less than 20% as a standard.

Comparative Examples 1, 2

In comparative example 1, although the same developer as that of examples 1 to 3 was used, in the case where the developer flow rate in the vicinity of the discharge port was not decelerated, the amount of developer was increased by 38%, and leakage of the developer and defective charging of toner due to defective agitation of the developer occurred.

In comparative example 2, although the same developer as that of examples 1 to 3 was used, in the case where the developer flow rate in the vicinity of the discharge port was made excessively slow, the increase in the amount of developer was as large as 23%. However, since it was made excessively slow in the vicinity of the discharge port, the developer conveyance itself was obstructed, and the torque of the development apparatus was increased by the defective circulation of the developer.

Examples 4 to 6

In a high temperature and high humidity environment, a life test of 300000 sheets was performed. The change of the angle of repose of the developer was from 31° to 49° and was rather large.

Example 4

Mixer pitch in discharge part was made ¼

Example 5

Mixer diameter was made ½

Example 6

The discharge port was provided in a so-called corner portion where the flow direction of the developer in the conveying chamber H was changed. The deceleration ratio of the flow rate was measured and it was 0.4.

Although the amount of developer was slightly increased in any of examples 4 to 6, it falls within the range of no problem.

Comparative Example 3

This was a case where a change in fluidity was large and the deceleration was not performed. An increase in the developer was 44% and was considerably large, and leakage of the developer and defective charging of toner due to defective agitation of the developer occurred.

Comparative Example 4

In the case where the change of fluidity was large and the speed was excessively decelerated, defective circulation of the developer occurred. Since the conveying speed in the vicinity of the discharge port was made excessively slow, the developer conveyance itself was obstructed, and the torque of the development apparatus was increased by the defective circulation of the developer.

Examples 7, 8

This is a case of a developer where a change in fluidity is small. With respect to a conveying flow passage of the developer, the area of the conveying flow passage was changed by the area changing unit 103' shown in FIG. 5. As stated above, also in the case were the change in fluidity is small, under the condition regulated by the invention, the change in the amount of developer is small, and an excellent result is obtained.

Examples 9, 10

In the case where an air environment in the development apparatus is changed to a low temperature and low humidity environment, the fluidity is changed toward a direction in which an angle of repose becomes small. In this case, although the amount of developer is slightly decreased, under the set condition of the invention, the result has no problem.

Comparative Example 5

In the case where the fluidity of developer becomes excellent and the speed is excessively decelerated, the developer is decreased. Although the example seldom occurs, in comparative example 5, a conveying defect occurred on the developing roller, and a defect in an image occurred.

Figure 9:
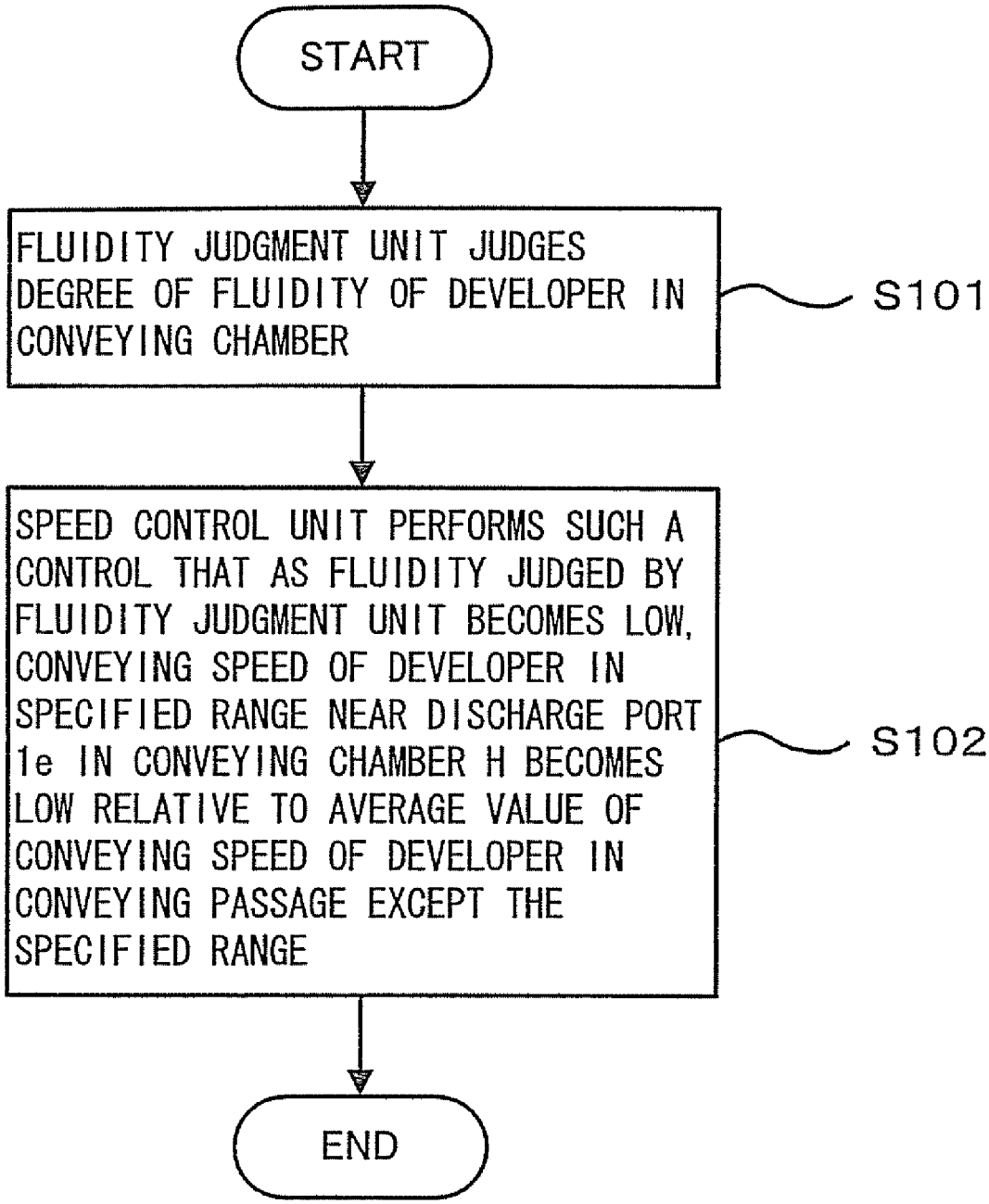
FIG. 9 is a flowchart for explaining the f low (developer conveying method) of a processing in the image forming apparatus of the embodiment.

FIG. 9 is a flowchart for explaining a processing flow (developer conveying method) in the image forming apparatus of the embodiment.

First, the fluidity judgment unit 202 judges the degree of fluidity of developer in the conveying chamber H (S101). Here, it is judged that as temperature and humidity in the development apparatus become high temperature and high humidity, the fluidity is low.

In addition, the fluidity judgment unit 202 can also judge that as the number of times of image formation processing in the image forming apparatus M from the time when a specified developer supply processing is performed for the conveying chamber H becomes large, the fluidity is low.

Besides, in the case where the image forming apparatus M can perform an image formation processing at plural process speeds different from each other, it is also possible to make a judgment that as the process speed at the time when the image formation processing is performed in the image forming apparatus M becomes low, the fluidity is low.

Then, the speed control unit 203 performs such a control that as the fluidity judged by the fluidity judgment unit 202 becomes low, the conveying speed of the developer in the specified range near the discharge port 1*e* in the conveying chamber H becomes low relative to the average value of the conveying speed of the developer in the conveying passage except the specified range (S102).

Specifically, when the conveying speed of the developer in the specified range near the discharge port 1*e* in the conveying chamber H is V1, and the average value of the conveying speed of the developer in the conveying passage except the specified range is V2, the speed control unit 203 performs a control to establish $$V1/V2=0.1 \text{ to } 0.7.$$

In other words, in the case of a=0.2 to 1.0, the speed control unit 203 controls the conveying speed of the developer so that the relation between the deceleration ratio of the developer flow rate in the vicinity of the discharge port 1*e* in the conveying chamber H to the average flow rate of the developer in the conveying chamber and the change rate of the developer fluidity becomes deceleration ratio of developer flow rate=a/(change degree of developer fluidity).

Here, the change degree of the developer fluidity is indicted as follows.

change degree of fluidity=angle of repose (after change)/angle of repose (initial state).

As stated above, in this embodiment, the angle of repose is used as the index indicating the fluidity of the developer.

Incidentally, the conveyance of the developer in the specified range near the discharge port 1*e* in the conveying chamber H and the conveyance of the developer in the conveying passage except the specified range are performed by the conveying means (the first conveying unit 101 and the second conveying means 102) which are different from each other and are controlled by the speed control unit 203.

In addition, the speed control unit 203 can also change the developer conveying speed in the specified range near the discharge port 1*e* in the conveying chamber H by changing the sectional area of the conveying passage in the specified range near the discharge port 1*e* in the conveying chamber H.

Incidentally, it is preferable that the speed control unit 203 performs such a control that the conveying speed of the developer in the specified range near the discharge port 1*e* in the conveying chamber H becomes the slowest speed among the developer conveying speeds in the conveying chamber H.

The respective steps in the foregoing processing in the image forming apparatus are realized by causing the CPU 801 to execute a developer conveying program stored in the MEMORY 802.

According to this embodiment, without large cost of, for example, new development of a developer that can suppress an environment variation and life variation, the developer can be stably discharged (the amount of developer in the development apparatus is stably kept at a specific amount) irrespective of a change in a developer physical property due to a change in a temperature and humidity environment. This embodiment can contribute to the stabilization of development identification as the development apparatus.

In this embodiment, although the description has been made to the case where the function to carry out the invention is previously recorded in the inside of the apparatus, no limitation is made to this, and the same function may be downloaded from a network to the apparatus, or the same function stored in a storage medium may be installed into the apparatus. As the recording medium, as long as the recording medium can store a program, such as a CD-ROM, and the apparatus can read, any mode may be adopted. Besides, the function previously obtained by installation or download as stated above may be realized in cooperation with the OS (Operating System) in the inside of the apparatus.

Although the invention has been described in detail with the specific mode, it would be obvious for one skilled in that art that various modifications and improvements can be made insofar as they do not depart from the spirit and scope of the invention.

As described above in detail, according to the invention, in the development apparatus in which the developer is replaced, the technique can be provided in which the amount of developer can be stably kept irrespective of the change in the developer physical property.

What is claimed is:

1. An image forming apparatus comprising:

a development apparatus that circulates and conveys a developer supplied at a specified timing in a specified conveying chamber and causes the developer to overflow through a discharge port provided in the conveying chamber;

a fluidity judgment unit configured to judge a degree of fluidity of the developer in the conveying chamber; and a speed control unit configured to control a conveying speed of the developer in a specified range near the discharge port in the conveying chamber to become low relative to an average value of a conveying speed of the developer in a conveying passage except the specified range when the fluidity judged by the fluidity judgment unit is low.

2. The image forming apparatus according to claim 1, further comprising an environment detection unit configured to detect temperature and humidity in the development apparatus, wherein the fluidity judgment unit judges that as the temperature and humidity detected by the environment detection unit become high temperature and high humidity, the fluidity is low.

3. The image forming apparatus according to claim 1, wherein the fluidity judgment unit judges that as the number of times of image formation processing in the image forming apparatus from a time when a specified developer supply processing is performed for the conveying chamber becomes large, the fluidity is low.

4. The image forming apparatus according to claim 1, wherein the image forming apparatus performs an image formation processing at plural process speeds different from each other, and the fluidity judgment unit judges that as the process speed at a time when the image formation processing is performed in the image forming apparatus becomes low, the fluidity is low.

5. The image forming apparatus according to claim 1, wherein when the conveying speed of the developer in the specified range near the discharge port in the conveying chamber is V1, and the average value of the conveying speed of the developer in the conveying passage except the specified range is V2, the speed control unit performs a control to establish $$V1/V2=0.1 \text{ to } 0.7.$$

6. The image forming apparatus according to claim 1, further comprising:

a first conveying unit configured to perform conveyance of the developer in the specified range near the discharge port in the conveying chamber; and a second conveying unit configured to perform conveyance of the developer in the conveying passage except the specified range, wherein the speed control unit controls a ratio of a conveying speed of the developer by the first conveying unit to a conveying speed of the developer by the second conveying unit.

7. The image forming apparatus according to claim 1, wherein the speed control unit controls the conveying speed of the developer in the specified range near the discharge port in the conveying chamber to become a slowest speed among developer conveying speeds in the conveying chamber.

8. The image forming apparatus according to claim 1, further comprising a process unit configured to integrally support a photoconductive body and at least one of a charger to charge a surface of the photoconductive body and the development apparatus, wherein the process unit is attachably and detachably provided to the image forming apparatus.

9. An image forming apparatus comprising:

a development apparatus that circulates and conveys a developer supplied at a specified timing in a specified conveying chamber and causes the developer to overflow through a discharge port provided in the conveying chamber;

a fluidity judgment unit configured to judge a degree of fluidity of the developer in the conveying chamber;

a speed control unit configured to control a conveying speed of the developer in a specified range near the discharge port in the conveying chamber to become low relative to an average value of a conveying speed of the developer in a conveying passage except the specified range when the fluidity judged by the fluidity judgment unit is low; and an area changing unit configured to change a sectional area of the conveying passage in the specified range near the discharge port in the conveying chamber, wherein the speed control unit changes the sectional area of the conveying passage in the specified range near the discharge port by the area changing unit.

10. A developer conveying method in an image forming apparatus including a development apparatus that circulates and conveys a developer supplied at a specified timing in a specified conveying chamber and causes the developer to overflow through a discharge port provided in the conveying chamber, the developer conveying method comprising:

judging a degree of fluidity of the developer in the conveying chamber; and controlling a conveying speed of the developer in a specified range near the discharge port in the conveying chamber to become low relative to an average value of a conveying speed of the developer in a conveying passage except the specified range when the judged fluidity is low.

11. The developer conveying method according to claim 10, wherein it is judged that as temperature and humidity in the development apparatus become high temperature and high humidity, the fluidity is low.

12. The developer conveying method according to claim 10, wherein it is judged that as the number of times of image formation processing in the image forming apparatus from a time when a specified developer supply processing is performed for the conveying chamber becomes large, the fluidity is low.

13. The developer conveying method according to claim 10, wherein the image forming apparatus performs an image formation processing at plural process speeds different from each other, and it is judged that as the process speed at a time when the image formation processing is performed in the image forming apparatus becomes low, the fluidity is low.

14. The developer conveying method according to claim 10, wherein when the conveying speed of the developer in the specified range near the discharge port in the conveying chamber is V1, and the average value of the conveying speed of the developer in the conveying passage except the specified range is V2, a control is performed to establish $$V1/V2=0.1 \text{ to } 0.7.$$

15. The developer conveying method according to claim 10, wherein conveyance of the developer in the specified range near the discharge port in the conveying chamber and conveyance of the developer in the conveying passage except the specified range are performed by conveying means different from each other.

16. The developer conveying method according to claim 10, wherein the conveying speed of the developer in the specified range near the discharge port in the conveying chamber is controlled to become a slowest speed among developer conveying speeds in the conveying chamber.

17. A developer conveying method in an image forming apparatus including a development apparatus that circulates and conveys a developer supplied at a specified timing in a specified conveying chamber and causes the developer to overflow through a discharge port provided in the conveying chamber, the developer conveying method comprising:

judging a degree of fluidity of the developer in the conveying chamber; and controlling a conveying speed of the developer in a specified range near the discharge port in the conveying chamber to become low relative to an average value of a conveying speed of the developer in a conveying passage except the specified range when the judged fluidity is low, wherein the conveying speed of the developer in the specified range near the discharge port in the conveying chamber is changed by changing a sectional area of the conveying passage in the specified range near the discharge port in the conveying chamber.

* * * * *